United States Patent [19]

Kopp

[11] Patent Number: 5,031,910

[45] Date of Patent: Jul. 16, 1991

[54] METHOD AND APPARATUS FOR BALL CATCH TRAINING

[76] Inventor: Harold W. Kopp, 137 Daytona Ave., Narragansett, R.I. 02882

[21] Appl. No.: 635,963

[22] Filed: Dec. 31, 1990

[51] Int. Cl.[5] ..... A63B 69/00

[52] U.S. Cl. ..... 273/55 R; 273/58 C

[58] Field of Search ..... 273/55 R, 26 E, 58 C, 273/319, 318, 320, 321, 335, 413, 414

[56] References Cited

U.S. PATENT DOCUMENTS

| | | | |
|---|---|---|---|
| 3,011,784 | 12/1961 | Segretto | 273/334 |
| 3,042,404 | 7/1962 | Masters | 273/55 R |
| 3,227,450 | 1/1966 | Pruitt | 273/58 C |
| 3,767,198 | 10/1973 | Boyer | 273/26 E |
| 3,804,409 | 4/1974 | Schachner | 273/58 C |
| 3,940,131 | 2/1976 | Civati | 273/55 R |
| 4,192,044 | 3/1980 | Ballerini | 273/58 C |
| 4,350,338 | 9/1982 | May | 273/58 C |
| 4,706,964 | 11/1987 | Genovese | 273/55 R |

FOREIGN PATENT DOCUMENTS

| | | | |
|---|---|---|---|
| 133090 | 6/1949 | Australia | 273/55 R |

*Primary Examiner*—Theatrice Brown

*Attorney, Agent, or Firm*—Charles S. McGuire

[57] ABSTRACT

Apparatus and method for training a football player the proper technique of catching the football comprises a football tethered with an elastic cord which is releasably attached to a stationary object at its opposite end. A second person grasps the football and stands a distance from the stationary object such that the elastic cord is pulled taut and stretched beyond its normal, relaxed length. The training player stands between the second person and the stationary object adjacent the cord and assumes a position ready to receive a pass. The second person simply releases the football which then travels to the training person along the path of the cord who attempts to catch the ball.

10 Claims, 2 Drawing Sheets

METHOD AND APPARATUS FOR BALL CATCH TRAINING

BACKGROUND OF THE INVENTION

This invention relates to sports training aids and, more particularly, to a football training aid and method designed to train a player to receive a pass.

In the game of football, it is very important that players learn proper techniques of catching the ball, as in a forward or lateral pass, or a snap from center. Various training devices have been developed to train football players in an attempt to increase their skills at passing, kicking and receiving a football. Quick repetitions of the proper body movements required to successfully pass, kick or receive the football have proven an effective training method. Training aids developed heretofore have thus typically taken the form of a tethered ball which returns in the proximity of the player following execution of the practice pass or kick such that prolonged retrieval of the ball is avoided and repetitions of shorter intervals may be made.

For example, U.S. Pat. No. 4,350,338 issued to Randall May on Sept. 21, 1982 discloses a tethered football having a harness arrangement for placement along the seams of the football which is used to return a passed or punted football. Similarly, U.S. Pat. No. 1,655,599 issued to Dolan, Jr. on June 21, 1923 discloses a tethered football having wing flaps used for practice kicking. It is obvious that a specially designed football is required to practice the Dolan patent and that the harness arrangement of May is prone to slippage and breakage. More importantly however, neither the May nor Dolan patents disclose or suggest the use of a tethered football for practice pass receiving, or otherwise aid in sharpening a player's skills in catching the ball.

It is therefore a main object of the present invention to provide a football training aid and method which is designed to effectively train a player to catch a moving ball.

It is a further object to provide a football training aid and method which permit quick repetitions of receiving the same practice football by a player.

It is another object to provide a football training aid and method which require no passing ability on the part of the player who delivers the practice football to the receiving player.

It is still another object to provide a football training aid which is simple in design and use, yet fully effective at training a football player to receive a pass in a variety of positions encountered under actual game conditions.

Other objects will in part be obvious and in part appear hereinafter.

SUMMARY OF THE INVENTION

In accordance with the foregoing objects, the apparatus of the invention comprises a tether assembly for attachment to the cover of a conventional football. In a first embodiment, the tether assembly comprises an elongated, elastic cord which may be knotted at one end for securement thereof inside an opening smaller than the knot created at one end of the cover of a deflated football. A swivel shackel is incorporated into the cord adjacent the end opposite to which the football cover is attached such that the football may rotate independently of the cord to prevent tangling during use. In a second embodiment, an annular bearing and uniquely configured securing element are placed about the cord adjacent the knot inside the cover of the football. The bearing and end piece permit rotation of the football independent of the cord to prevent the cord from tangling during use such that the swivel shackel of the first embodiment is not needed. In both embodiments, the opposite end of the elastic cord is provided with means for releasable attachment to a stationary object such as a fence or post.

The method of using the training aid requires two players, a first player to catch the ball and a second player to deliver the ball to the first player. The second player grasps the football and assumes a position a distance from the stationary object to which the opposite end of the cord is attached with the cord pulled taut such that it is stretched beyond its normal relaxed length. The first player i.e., receiving player) then stands between the stationary object and the second player holding the football in a location immediately adjacent the taut cord. The receiving player assumes a position for the type of pass the second person is about to deliver depending upon the height at which he is about to release the ball from. This could be a variety of receiving positions typically encountered in regular game play, such as over-the-head, mid-section and lower body section, as well as over-the-shoulder and a position to receive a "snap" from the center. The second player simply releases the football which is quickly drawn to the receiving player by the pulling action of the stretched elastic cord on the football. The speed of the released football depends upon the extent to which the elastic cord had been stretched by the second player and may therefore be regulated as desired. Following release of the ball, the second player retrieves the ball which is either in the hands of the receiving player, if he was successful at catching the ball, or lying somewhere near the stationary object to which the cord is attached. Training is continued in the same manner as before, i.e., the second player pulls the cord taut and releases the football to the training player repetitively.

DETAILED DESCRIPTION

Figure 1:
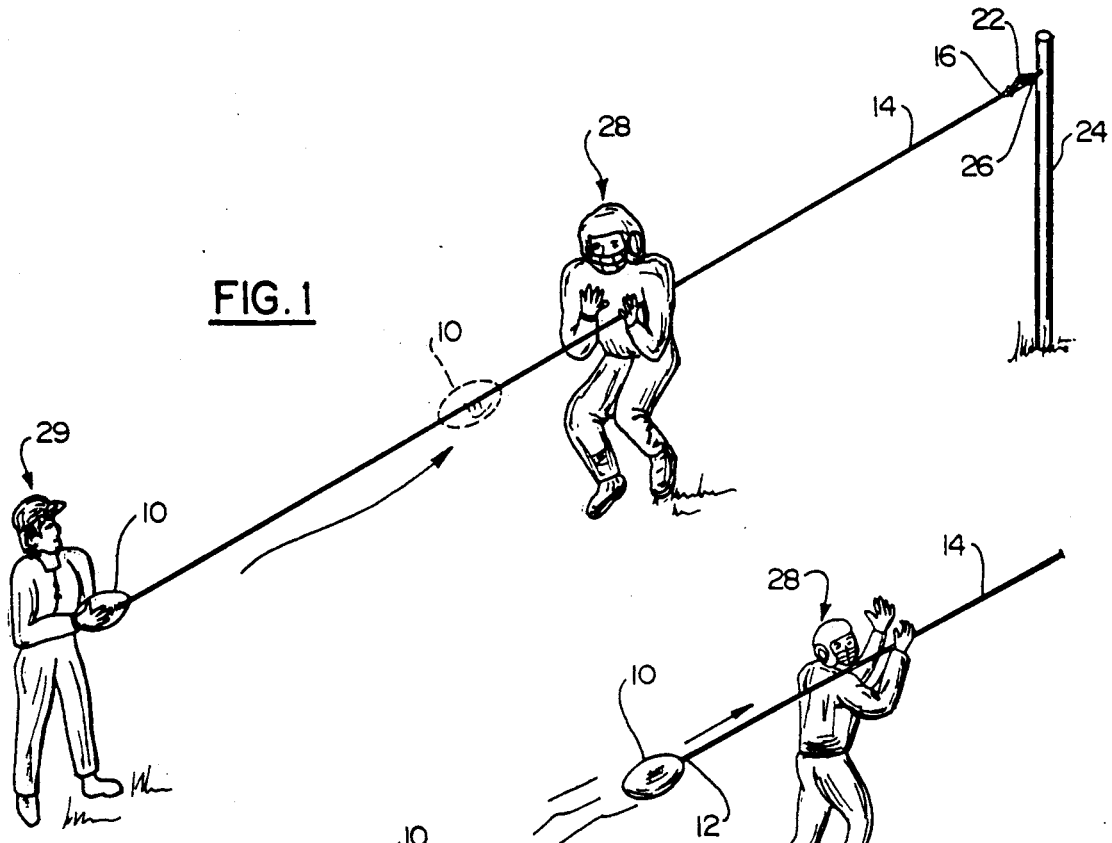
FIG. 1 is a perspective view showing the second player delivering a football attached to the training aid assembly to the first player in a position to receive a mid-section pass.

Referring now to the drawings, there is seen in the various figures two embodiments of the training assembly of the invention for attachment to cover 30 of a conventional football 10 in wide use today. In both embodiments, the cover 30 of the football 10 must be prepared for attachment to the first end 12 of an elastic cord 14 as will be fully described below. The opposite end 16 of cord 14 is attached to a clip 18 by a knot 20 passed through and tied to the eye 22 thereof although other equivalent means of attachment are possible. Clip 18 is provided for the releasable attachment of the training assembly to a stationary object such as the post 24 seen in FIG. 1 onto which a large eye screw 26 has been mounted. Other stationary objects such as a chain link fence, for example, may be used for the releasable attachment of the training assembly described herein. Attachment of clip 18 to the stationary object is preferably approximately shoulder height to the training player 28.

Turning attention to the method whereby cord end 12 is attached to a football 10, it is necessary to first deflate bladder 11 and unlace the football 10 to access the inside cavity of the football. A small opening is made at one end of the football to the side of bladder 11 where the longitudinal seams of the football meet which may be easily accomplished by snipping the threads with a scissor and securing the loose ends thereof to prevent further unraveling. Referring first to the embodiment seen in FIG. 3, the exterior skin or cover of the football 10 is indicated by reference numeral 30 and the small opening made at an end thereof is referenced by numeral 37. A knot 40 is formed at a first end 12 of cord 14. The opposite end 16 of cord 14 (absent elements 17 and 18) is passed through opening 37 from the inside of cover 30 until knot 40 abutts opening 37. The size of knot 40 is large enough such that it will not push through opening 37 and detach from cover 30. With end 12 thus secured to cover 30, opposite end 16 is subsequently equipped with a swivel shackel 17 and knotted to clip 18 in the manner aforementioned. The swivel shackel 17 provides for rotation of football 10 and cord 14 without cord 14 tangling.

Figure 5:
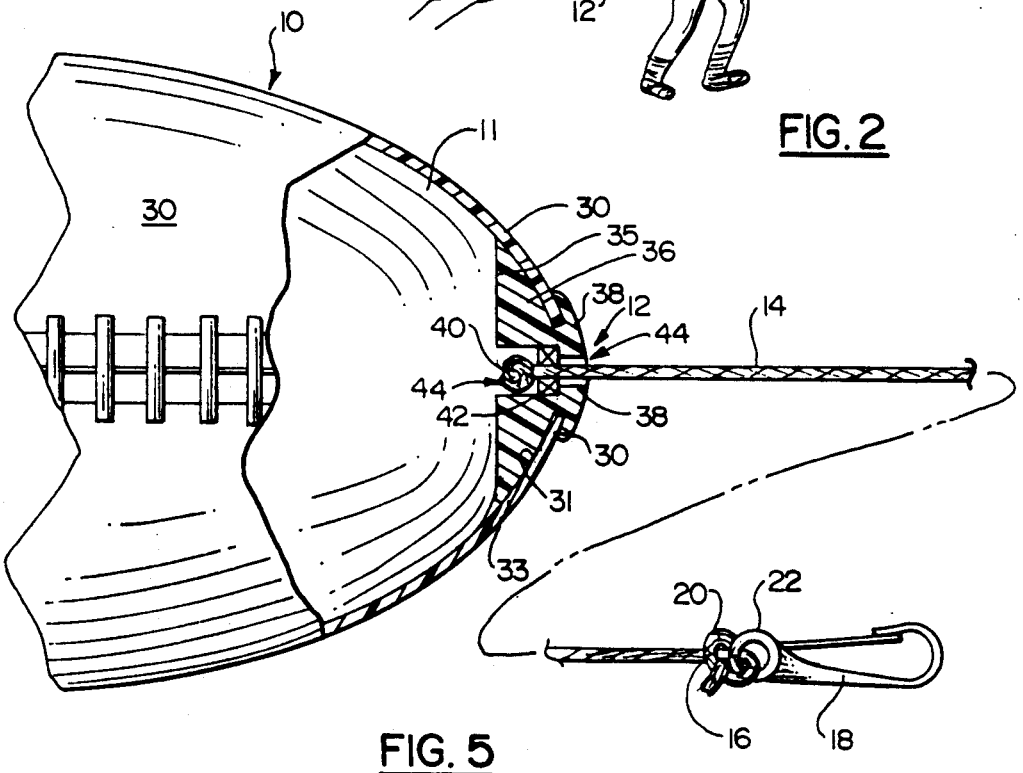
FIG. 5 is a side, elevational view of the embodiment of FIG. 4 shown here with the cord and attachment means attached to the football cover in the intended manner.
Figure 4:
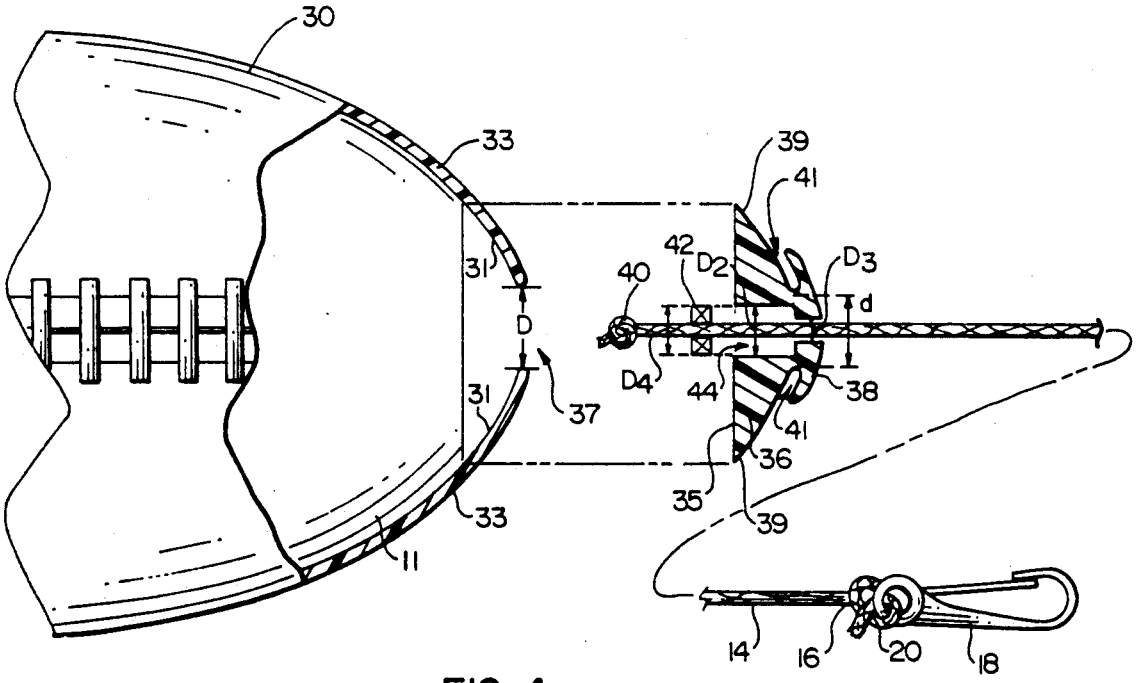
FIG. 4 is a side, elevational view of a second embodiment of the training assembly with the cord and attachment means shown in exploded relation to the football.

In the second embodiment seen in FIGS. 4 and 5, a cord securing element 36 of generally circular configuration having a central, longitudinal bore 44 is provided having a planar bottom surface 35 with a first portion thereof having a convex surface 39 extending therefrom which contacts the inside surface 31 of the football cover 30 adjacent opening 37 in the attached position of element 36 seen in FIG. 5. An integral, annular flange 38 extends from the convex surface 39 of securing element 36 to form an annular groove 41 into which portions of outer cover 30 adjacent opening 37 snugly fit. In this regard, it may be seen in FIG. 4 that the diameter D of opening 37 is substantially the same as the diameter d of securing element 36 as measured at the junction of convex surface 39 and flange 38.

Figure 3:
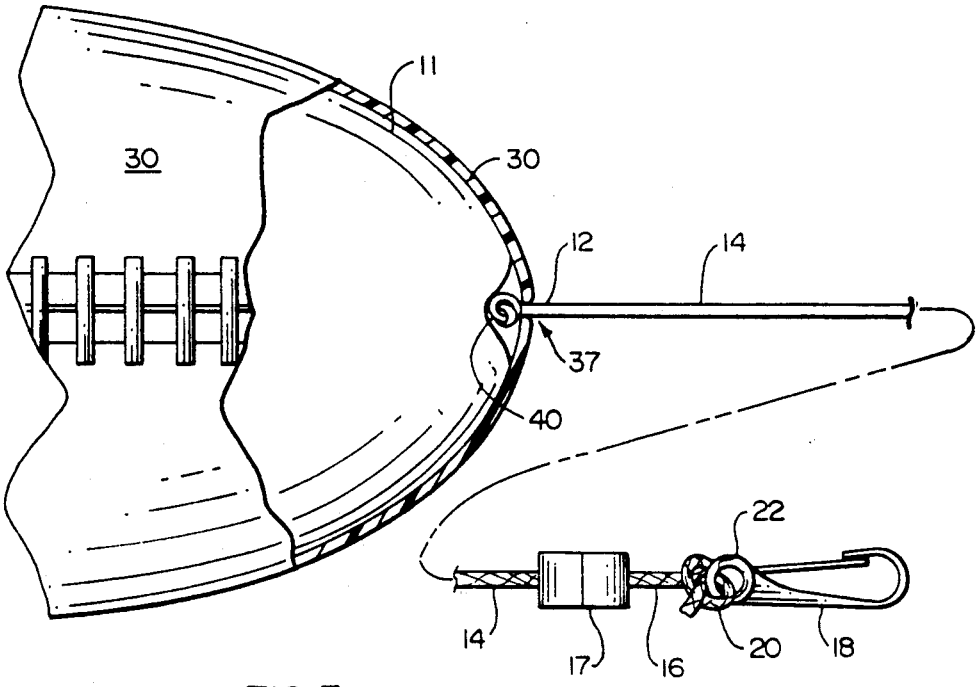
FIG. 3 is a side, elevational view of a first embodiment of the training assembly with portions of the football partly broken away and portions shown in cross section.

To insert securing element 36 into the position seen in FIG. 5, football 10 is deflated and unlaced. Element 36 is inserted through the opening created by unlacing the football. Deflated bladder 11 is pushed aside and annular flange 38 is pressed through opening 37 created at the end of football 10 until it is in the position seen in FIG. 5 with the portions of cover 30 adjacent opening 37 fit snugly into groove 41 between convex surface 39 and flange 38. Next, an annular bearing 42 is positioned about cord 14 and cord 14 is knotted at end 40 adjacent bearing 42. The opposite end 16 of cord 14 is passed through longitudinal bore 44 in element 36 and affixed to clip 18 as aforementioned. As seen in FIG. 4, the diameter $D_2$ of bore 44 in the first portion of element 36 is greater than the diameter $D_3$ in the second portion of element 36. Also, the diameter $D_4$ of bearing 42 is substantially the same as diameter $D_2$ in the first portion of element 36 such that bearing 42 with cord 14 extending therethrough may be positioned within bore 44 in the first portion of element 36 adjacent the junction of the second portion of element 36. Football 10 is laced back up and reinflated to its normal pressure. It should be evident that during use of the training aid, exertion of knot 40 against bearing 42 allows rotation of cord 14 within longitudinal bore 44 of element 38, independent of football 10 and the swivel shackel 17 seen in FIG. 3 is therefore not necessary. It is also stressed herein that with either embodiment shown and described herein, the football 10 used is a conventional football in wide use today. The attachment of either tether assembly shown in FIG. 3 and FIGS. 4 and 5 do not compromise the integrity of the football in any way.

Turning attention now to the method of training a football player the proper way to receive a pass with the apparatus just described, the clip 18 is attached to a stationary object such as the post 24 seen in FIG. 1 via eye screw 26 mounted thereon. As previously mentioned, attachment of the cord 14 to a stationary object should be approximately shoulder height to the training player 28. A second player or coach 29 grasps the football 10 with cord 14 attached thereto and assumes a position a distance from stationary post 24 such that cord 14 is stretched beyond its normal, relaxed length. The further the cord 14 is stretched, the faster the football 10 will travel toward the player 28 upon release by the coach 29. The speed of football 10 may therefore be regulated by the coach 29 at his discretion.

Figure 2:
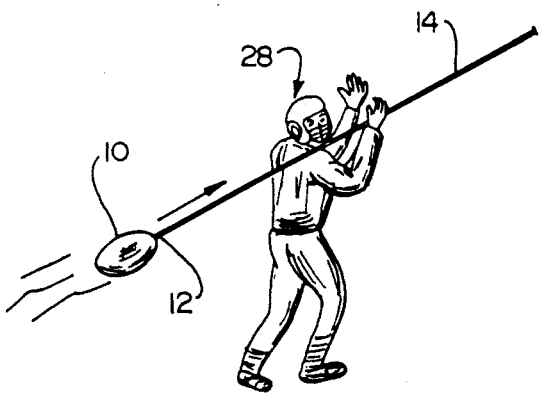
FIG. 2 is a perspective view of the first player in a position to receive an over-the-shoulder reception with portions of the training assembly shown broken away.

With coach 29 in position as seen in FIG. 1, training player 28 assumes a position adjacent cord 14, preferably closer to stationary post 24 than to the coach 29. The coach 29 then tells the training player 28 what kind of pass he should be ready to receive, for example a mid-section pass as seen in FIG. 1 or an over-the-shoulder pass as seen in FIG. 2. The height at which the coach 29 holds and releases the football 10 dictates at what height the training player 28 will receive football 10. For instance in FIG. 1, coach 29 is releasing football 10 at his mid-section which, in turn, delivers football 10 to training player's 28 mid-section. Although not shown in FIG. 2, the coach 29 would release football 10 slightly above shoulder height to deliver football 10 to training player 28 who is positioned to receive an over-the-shoulder pass. If a snap receival is desired, coach 29 would release the football 10 somewhere adjacent his shin level.

If training player 28 is successful at receiving football 10, he simply hands it back over to coach 29 for another pass. If he doesn't catch the football 10, football 10 will lie somewhere near post 24 since it is attached to cord 14 and coach 29 may retrieve it quickly from that spot. It may be readily realized therefore, that relatively quick repetitions of simulated passes may be made to a training player 28. It may also be realized that no passing ability is required by the person who delivers football 10 to the training player 28, such as the coach 29 seen in FIG. 1. Thus, during football practice sessions, a quarterback is not needed for all receiving practice plays. Also, the speed at which football 10 is delivered to training player may be readily and easily regulated by the distance at which cord 14 is pulled taut.

There is thus provided a football training aid in which a novel and unique method of training football players the proper way to receive a variety of passes is disclosed. Although only two embodiments of a tethered football assembly have been shown and described herein, it is pointed out that other similar, known tethered football assemblies may be used with the training method herein described. Accordingly, the spirit and scope of the invention herein described is limited only insofar as the following claims dictate.

What is claimed is:

1. A method of training a first person to catch a ball comprising the steps of:

a.) fixedly attaching a first end of an elastic cord to said ball;

b.) releasably attaching a second end of said elastic cord to a stationary object;

c.) positioning a second person at a distance from said stationary object wherein said elastic cord is pulled taut and is stretched beyond its normal, relaxed length with said second person holding said ball;

d.) positioning said first person between said second person and said stationary object adjacent said taut cord, said first person assuming a position ready to catch said ball upon release thereof by said second person; and e.) said second person releasing said ball,whereby tension is released in said cord and said ball travels from said second person to said first person along the path of said cord.

2. The method of claim 1 wherein said ball is a football having an outer cover and an inflatable, internal bladder.

3. The method of claim 2 and further comprising the steps of:

a.) at least partially deflating said bladder;

b.) unlacing said football to provide access to the inside thereof;

c.) forming an opening of predetermined diameter at one end of said football where the longitudinal seams of said football meet;

d.) forming a knot at said cord first end;

e.) passing said cord second end through said opening from said inside of said football until said knotted, first end of said cord abutts said opening and wherein said cord includes means to prevent said knotted, first end from passing through said opening;

f.) re-lacing said football; and g.) re-inflating said internal bladder of said football.

4. The method of claim 3 wherein said means comprises the steps of:

a.) positioning a substantially circular securing element having a longitudinal bore at said opening with portions of said cover adjacent said opening secured to said element;

b.) positioning an annular bearing in said longitudinal bore and concentric with said bore; and c.) passing said cord through said bore and said bearing until said knotted, first end rests against said bearing whereby said cord may rotate independently of said football.

5. A tether assembly for football catch training comprising:

a.) a football having an outer cover and internal bladder with a longitudinal axis passing through first and second ends of said cover and including an opening of predetermined configuration and size formed at one of said first and second ends;

b.) an elongated, elasticized cord having first and second ends;

c.) means fixedly securing said cord first end adjacent said opening internally of said outer cover with said cord extending through said opening externally of said outer cover; and d.) means releasably attaching said cord second end to a stationary object.

6. The invention according to claim 5 wherein said cord first end securing means comprises a knot formed at said cord first end, said knot having a configuration and size larger than said opening predetermined configuration and size whereby said knot is prevented from passing through said opening.

7. The invention according to claim 6 wherein said cord second end securing means comprises a clip attached to said second end for releasable attachment thereof to a stationary object.

8. The invention according to claim 7 and further including a swivel shackel incorporated into said cord adjacent said second end thereof thereby permitting axial rotation of said football independent of said cord second end.

9. The invention according to claim 8 wherein said cord second end releasable securing means comprises a clip attached to said second end.

10. The invention according to claim 5 wherein said cord first end securing means comprises:

a.) a knot formed at said cord first end;

b.) a securing element of generally circular configuration having a central, longitudinal bore, said securing element having a planar bottom surface with a first portion of said securing element extending therefrom having a convex surface, said bore in said first portion being a first diameter, and a second portion of said securing element extending integrally from said first portion to form a flange having a concave, inner surface in spaced relation to said convex surface whereby a groove is formed between portions of said convex surface and said inner surface of said flange at the junction of said first and second portions, said second portion bore being a second diameter which is smaller than said first diameter, said securing element positioned within said opening with portions of said outer cover adjacent said opening engaged between said portions of said convex surface and said flange in said groove such that said first portion of said securing element is positioned internally of said outer cover and said second portion of said securing element is located externally of said outer cover; and c.) an annular bearing having first and second sides positioned around said cord with said first side adjacent said knot, said bearing positioned inside said first portion bore of said securing element such that said bearing and said first portion bore are concentric, said bearing second side abutting said second portion bore with said cord extending through said longitudinal bore of said securing element externally of said football outer cover.

* * * * *